US008511492B2

(12) United States Patent
Webster et al.

(10) Patent No.: US 8,511,492 B2
(45) Date of Patent: Aug. 20, 2013

(54) BOTTLE WITH HANDLE VENTING INLET AND CHILD RESISTANT FLIP-TOP CLOSURE WITH POURING SPOUT AND DRAINBACK HOLE

(75) Inventors: Judith Webster, Pleasanton, CA (US); Kerry Azelton, Pleasanton, CA (US); Steve James Tomkins, Pleasanton, CA (US); Brandon C. Roy, McDonough, GA (US); Christian Krammer, Hard (AT); Thomas Hlavacek, Hard (AT); Thomas Zauser, Hard (AT)

(73) Assignee: The Clorox Company, Oakland, CA (US)

( * ) Notice: Subject to any disclaimer, the term of this patent is extended or adjusted under 35 U.S.C. 154(b) by 363 days.

(21) Appl. No.: 12/860,045

(22) Filed: Aug. 20, 2010

(65) Prior Publication Data

US 2012/0043295 A1 Feb. 23, 2012

(51) Int. Cl.

| | |
|---|---|
| ***B65D 50/04*** | (2006.01) |
| ***B65D 43/16*** | (2006.01) |
| ***B65D 51/16*** | (2006.01) |

(52) U.S. Cl.

USPC ..... 215/309; 215/41; 215/44; 215/216; 215/224; 215/237; 215/243; 220/259.1; 220/254.3; 222/111; 222/468; 222/484; 222/556; 222/568; 222/571

(58) Field of Classification Search

USPC ..... 215/206, 209, 223, 230, 235–237, 215/245, 305, 306, 309, 40, 41, 43, 44, 216–221, 215/224, 243, 329; 220/254.3–254.5, 259.1, 220/281–283; 222/108, 109, 111, 153.14, 222/556, 484, 567–568, 571

See application file for complete search history.

(56) References Cited

U.S. PATENT DOCUMENTS

| | | | | | |
|---|---|---|---|---|---|
| 292,660 | A | * | 1/1884 | Lang et al. | 215/244 |
| 1,768,098 | A | * | 6/1930 | Aulbach | 222/109 |
| 3,168,221 | A | * | 2/1965 | Parker | 222/109 |
| 3,307,752 | A | * | 3/1967 | Anderson | 222/465.1 |
| 3,506,167 | A | * | 4/1970 | Orr | 222/479 |
| 3,603,470 | A | * | 9/1971 | Armour | 215/213 |
| 4,121,728 | A | | 10/1978 | Tagalakis et al. | |
| 4,311,246 | A | | 1/1982 | Saito et al. | |
| 4,444,326 | A | * | 4/1984 | Musel | 215/209 |
| 4,629,598 | A | | 12/1986 | Thompson | |
| 4,718,567 | A | * | 1/1988 | La Vange | 215/216 |
| 4,759,455 | A | * | 7/1988 | Wilson | 215/206 |
| 4,789,074 | A | | 12/1988 | Han | |
| 4,804,119 | A | | 2/1989 | Goodall | |
| 4,890,770 | A | | 1/1990 | Haga et al. | |
| 4,917,268 | A | * | 4/1990 | Campbell et al. | 222/109 |

(Continued)

FOREIGN PATENT DOCUMENTS

| | | | |
|---|---|---|---|
| DE | 3632057 C | * | 1/1988 |
| DE | 3625477 A1 | * | 2/1988 |

(Continued)

*Primary Examiner* — J. Gregory Pickett
*Assistant Examiner* — Ned A Walker
(74) *Attorney, Agent, or Firm* — Alok Goel; David Peterson

(57) ABSTRACT

Described is a bottle having a container which includes a threaded neck and a handle. The threaded neck includes a dispensing opening and a handle opening. The bottle also includes a dispensing closure configured to engage the container. The bottle also includes a child-resistant closure cap which includes a pair of tabs that lock into the latches on the closure base member.

8 Claims, 8 Drawing Sheets

(56) References Cited

U.S. PATENT DOCUMENTS

| | | | | |
|---|---|---|---|---|
| 4,940,167 | A * | 7/1990 | Fillmore et al. | 222/153.09 |
| D310,960 | S | 10/1990 | Verebelyi | |
| D319,981 | S * | 9/1991 | Sledge | D9/447 |
| 5,069,367 | A * | 12/1991 | Salmon et al. | 222/153.06 |
| 5,392,947 | A * | 2/1995 | Gentile | 220/665 |
| 5,449,077 | A * | 9/1995 | Seidler | 215/216 |
| 5,551,582 | A | 9/1996 | Robinson | |
| 5,579,957 | A * | 12/1996 | Gentile et al. | 222/153.14 |
| 5,706,963 | A * | 1/1998 | Gargione | 215/219 |
| 5,722,546 | A | 3/1998 | Briere | |
| 5,722,570 | A | 3/1998 | Sultzer, III et al. | |
| 5,730,306 | A | 3/1998 | Costa et al. | |
| 5,765,705 | A * | 6/1998 | Deubel | 215/216 |
| 5,794,803 | A | 8/1998 | Sprick | |
| 6,202,870 | B1 | 3/2001 | Pearce | |
| 6,223,945 | B1 | 5/2001 | Giblin et al. | |
| 6,360,924 | B1 * | 3/2002 | Franzen | 222/468 |
| 6,510,971 | B1 * | 1/2003 | Martin | 222/556 |
| D470,416 | S | 2/2003 | Blair et al. | |
| 6,543,650 | B1 | 4/2003 | Sprick et al. | |
| 6,698,605 | B2 | 3/2004 | Clodfelter et al. | |
| 6,834,769 | B2 * | 12/2004 | Takahashi et al. | 215/235 |
| 6,854,619 | B2 * | 2/2005 | Knickerbocker | 222/1 |
| 6,866,164 | B2 * | 3/2005 | Branson et al. | 222/153.14 |
| 6,871,752 | B2 | 3/2005 | Montgomery | |
| D508,402 | S * | 8/2005 | Hierzer et al. | D9/449 |
| 6,923,341 | B2 | 8/2005 | Smith | |
| 6,932,249 | B1 * | 8/2005 | Pugne | 222/556 |
| 6,983,857 | B2 | 1/2006 | Miller et al. | |
| D515,917 | S * | 2/2006 | Hierzer et al. | D9/447 |
| 7,048,140 | B1 | 5/2006 | Caldwell | |
| RE39,727 | E | 7/2007 | Sprick et al. | |
| 7,296,711 | B2 * | 11/2007 | Hayakawa et al. | 222/153.14 |
| 7,306,121 | B2 | 12/2007 | Ophardt et al. | |
| 7,328,820 | B2 * | 2/2008 | Young | 222/484 |
| D580,762 | S * | 11/2008 | Wilson et al. | D9/449 |
| 7,549,559 | B2 | 6/2009 | Conroy et al. | |
| 7,798,348 | B2 * | 9/2010 | Sawyer | 215/237 |
| 7,861,873 | B1 * | 1/2011 | Bragg et al. | 215/237 |
| 7,959,034 | B2 * | 6/2011 | Faaborg et al. | 222/109 |
| 8,011,535 | B2 * | 9/2011 | Tauber et al. | 222/109 |
| 8,074,821 | B2 * | 12/2011 | Yeager | 220/254.3 |
| 8,123,057 | B2 * | 2/2012 | Kunz et al. | 215/216 |
| 8,292,101 | B1 * | 10/2012 | Bragg et al. | 215/237 |
| 8,292,110 | B2 * | 10/2012 | Rutter et al. | 220/254.3 |
| 2002/0134795 | A1 | 9/2002 | Hierzer et al. | |
| 2003/0201283 | A1 | 10/2003 | Branson et al. | |
| 2004/0074919 | A1 | 4/2004 | Knickerbocker | |
| 2004/0140329 | A1 | 7/2004 | Rainey et al. | |
| 2005/0133475 | A1 * | 6/2005 | Goto et al. | 215/237 |
| 2005/0163952 | A1 | 7/2005 | Beale | |
| 2005/0205607 | A1 * | 9/2005 | Hierzer et al. | 222/153.1 |
| 2006/0016776 | A1 * | 1/2006 | Barre et al. | 215/237 |
| 2007/0095864 | A1 * | 5/2007 | Vangeel et al. | 222/556 |
| 2007/0144996 | A1 | 6/2007 | Sawyer | |
| 2007/0175931 | A1 | 8/2007 | Leoncavallo et al. | |
| 2007/0201941 | A1 | 8/2007 | Koptis | |
| 2007/0215646 | A1 | 9/2007 | Foster | |
| 2007/0228042 | A1 * | 10/2007 | Yeager | 220/254.3 |
| 2007/0278174 | A1 * | 12/2007 | Kunz et al. | 215/224 |
| 2008/0110849 | A1 | 5/2008 | Wachsberg | |
| 2008/0245795 | A1 * | 10/2008 | Berge | 220/264 |
| 2009/0152269 | A1 * | 6/2009 | Pucci | 220/254.3 |
| 2011/0284541 | A1 * | 11/2011 | Webster et al. | 220/288 |
| 2011/0284595 | A1 * | 11/2011 | Jamieson et al. | 222/465.1 |
| 2011/0297698 | A1 * | 12/2011 | Chiang et al. | 222/109 |

FOREIGN PATENT DOCUMENTS

| | | | |
|---|---|---|---|
| DE | 20009203 | U1 * | 6/2001 |
| GB | 2449704 | A * | 12/2008 |
| JP | 11070955 | A * | 3/1999 |
| WO | WO 2006122612 | A1 * | 11/2006 |
| WO | WO 2009089602 | A1 * | 7/2009 |
| WO | PCT/US11/048444 | | 1/2012 |

* cited by examiner

BOTTLE WITH HANDLE VENTING INLET AND CHILD RESISTANT FLIP-TOP CLOSURE WITH POURING SPOUT AND DRAINBACK HOLE

BACKGROUND OF THE INVENTION

1. Field of the Invention

This invention relates generally to bottle closures on bottles for dispensing liquids, such as liquid cleaners and the like. More particularly, the present invention relates generally to flip top and screw top closures on handled bottles with pouring spouts.

2. Description of the Related Art

A typical directional pour spout with a flip top cap is described in U.S. Pat. No. 7,549,559 to Conroy et al. A child-proof closure for a flip top cap is described in U.S. Pat. 2007/0144996 to Sawyer. A typical bottle with an integral handle and method of making is described in U.S. 2005/0163952 to Beale and U.S. Pat. No. 4,629,598 to Thompson.

A variety of solutions have been disclosed for storage venting of screw top closures. For example, U.S. Pat. No. 6,202,870 to Pearce discloses ridges with slots or grooves on the inside top horizontal surface of a screw cap to allow venting from inside the bottle. Another example of screw cap venting is disclosed in U.S. Pat. No. 7,048,140 to Caldwell, where the screw cap is slotted through the threads and on the inside top surface. Other venting solutions applicable to screw top containers have used venting liners, i.e. U.S. Pat. No. 6,983,857, U.S. Pat. No. 4,121,728, and U.S. Pat. No. 4,789,074.

Accordingly, what is needed is a suitable flip top, child-resistant closure with a pour spout for a handled bottle.

SUMMARY OF THE INVENTION

In accordance with the principles of the present invention, in one embodiment, a bottle comprises a container having a threaded neck on the container top front surface and having an enclosed handle on the container top rear surface wherein the neck comprises a container outlet and a separate handle inlet; a dispensing closure comprising a base member, a cap having a top and sidewalls, and a hinge connecting the base member and the cap, wherein the base member has a top wall with a depending outer concave flared sidewall and a depending intermediate wall having a pair of latches and a thread segment and connecting to an intermediate deck with a depending inner wall connecting to a lower deck having a beveled spout wherein the cap has a pair of tabs each having a tab wall connecting a tab lug that locks into one of the latches.

According to another embodiment of the present invention, a bottle comprises a container having a threaded neck on the container top front surface and having an enclosed handle on the container top rear surface wherein the neck comprises a container outlet and a separate handle inlet; a dispensing closure comprising a base member, a cap having a top and sidewalls, and a hinge connecting the base member and the cap, wherein the base member has a top wall with depending outer sidewall and a depending inner wall with a pair of latches on opposite sides of the base member and a deck member wherein the deck member comprises a beveled spout; wherein the cap sidewall has a pair of tab cutouts each containing a tab having a tab wall with tab lug that locks into a corresponding latch.

According to a further embodiment of the present invention, a bottle comprises a container having a threaded neck on the container top front surface and having an enclosed handle on the container top rear surface wherein the neck comprises a container outlet and a separate handle inlet; a dispensing closure comprising a base member, a cap, and a hinge connecting the base member and the cap, wherein the base member has a depending outer sidewall and an inner threaded wall with a pair of latches on opposite sides of the base member and a deck member wherein the deck member comprises a beveled spout, wherein the cap has a pair of tabs having tab lugs that lock into the latches, wherein the base member is opaque and the cap is from a group consisting of translucent, transparent, or a combination thereof.

The use of the bottle of the present invention, from a consumer perspective, would not differ from the use of any conventional dispensing bottle known in the art. The user would simply open the closure mechanism to dispense fluid from the bottle. The user in one embodiment of invention must squeeze two opposing tabs while at the same time lifting the cap.

Further features and advantages of the present invention will become apparent to those of ordinary skill in the art in view of the detailed description of embodiments below, when considered together with the attached drawings and claims.

BRIEF DESCRIPTION OF THE DRAWINGS

The foregoing aspects and others will be readily appreciated by the skilled artisan from the following description of illustrative embodiments when read in conjunction with the accompanying drawings, in which.

DETAILED DESCRIPTION

Reference will now be made to the drawings wherein like numerals refer to like parts throughout. For ease of description, the components of this invention are described in the normal (upright) operating position, and terms such as upper, lower, horizontal, top, bottom, etc., are used with reference to this position. It will be understood, however, that the components embodying this invention may be manufactured, stored, transported, used, and sold in an orientation other than the position described.

Figures illustrating the components of this invention show some conventional mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

All publications, patents and patent applications cited herein, whether supra or infra, are hereby incorporated by reference in their entirety to the same extent as if each individual publication, patent or patent application was specifically and individually indicated to be incorporated by reference.

As used herein and in the claims, the term "comprising" is inclusive or open-ended and does not exclude additional unrecited elements, compositional components, or method steps. Accordingly, the term "comprising" encompasses the more restrictive terms "consisting essentially of" and "consisting of".

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

The term "bottle", as used herein, is meant to mean and include any plastic container and closure for holding a fluid.

Figure 1:
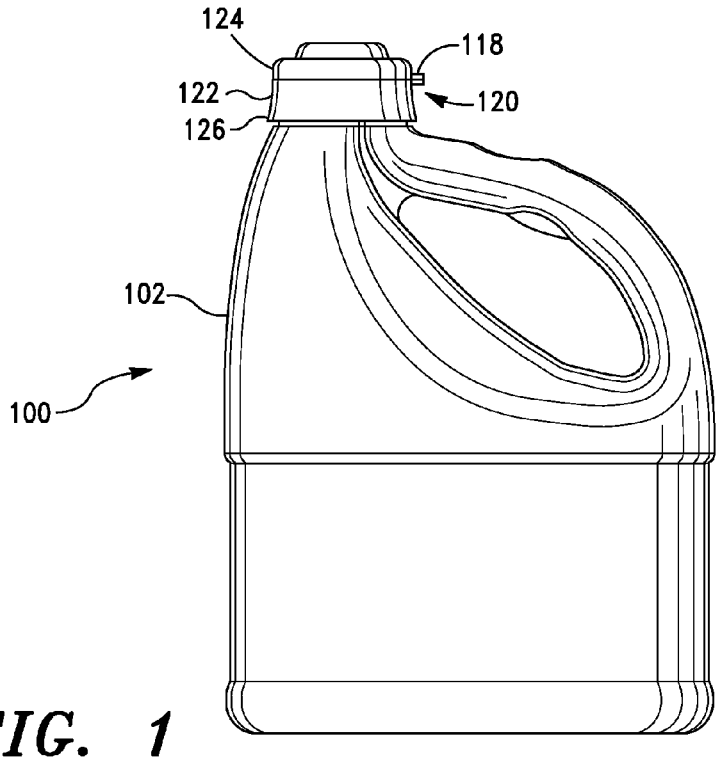
FIG. 1 shows a side plan view of a bottle in accordance with an embodiment of the present invention.
Figure 2:
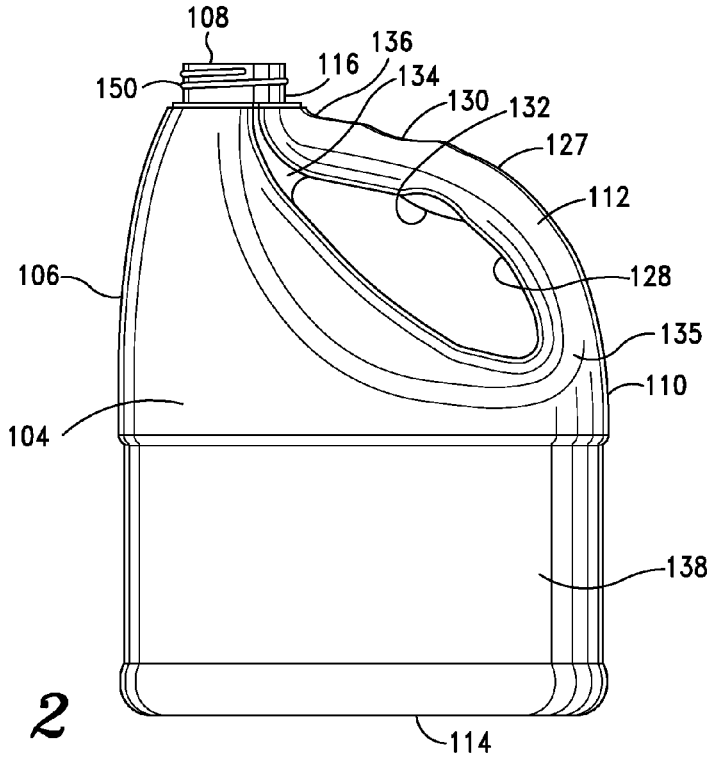
FIG. 2 shows a side plan view of a container in accordance with an embodiment of the present invention.

In a suitable embodiment as shown in FIGS. 1 and 2, the bottle 100 comprises a container 102 having a body portion 104 for holding container content, with a container front side 106 adjacent to the dispensing opening 108 and a rear side 110 adjacent to the handle 112, and a lower closed bottom end 114 for supporting the container 102. The container has an upper end including a neck 116 delimiting a dispensing opening 108. A dispensing closure 120 of the present invention, having a base member 122 with a curved flared sidewall 126, a cap 124, and a connecting hinge 118 may be securely mounted onto said container 102 via its base member 122, using any means of attachment commonly know to those skilled in the art including cooperative threads, crimping, clipping means, heat sealing, force fitting, clasp elements, snap-fit bead, groove arrangements, and mixtures thereof. The curved flared sidewall 126 of the base member 122 provides for a more stable grip of the base member 122 as one hand grips the base member 122 and the other hand opens the cap 124.

Figure 3:
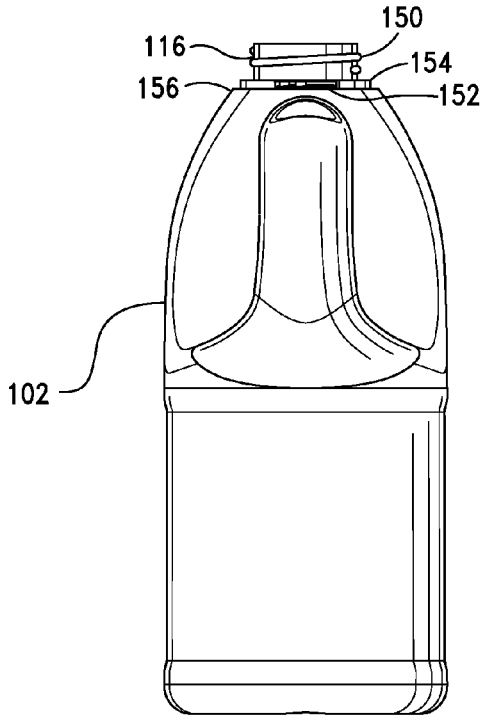
FIG. 3 shows a rear plan view of a container in accordance with an embodiment of the present invention.
Figure 4:
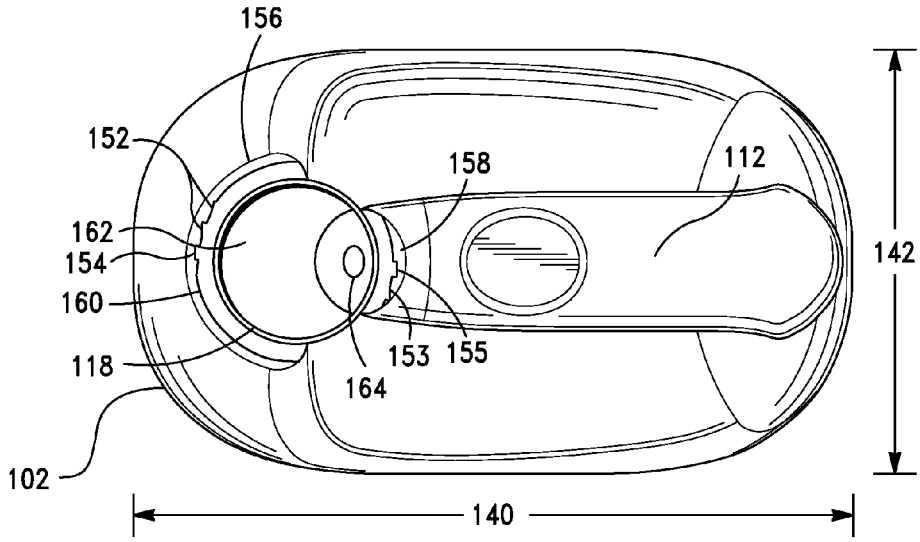
FIG. 4 shows a top plan view of a container in accordance with an embodiment of the present invention.

The container 102 can have an enclosed handle 112 with an extended handle exterior 127 and an enclosed extended handle interior 128. The bottle has a thumb pad 130 on the extended handle exterior 127 and a forefinger alignment nub 132 on the extended handle interior 128. These handle easy-grip features are suitable for a forward directed pouring spout which is tipped during pouring to a lesser extent than is required for a more central directed pouring spout on the top of a bottle. A solid web 134 separates the handle top end 136 from the container front side 106 where the handle top end 136 and the container front side 106 both enter the neck 116. The handle bottom end 135 is fluidly connected to the container body portion 104 about half way up the container rear side 110. The handle top end 136 is fluidly connected to the dispensing opening 108 at the neck 116. Below the handle 112 is an indented label wall 138. As shown in FIGS. 2-4, the container 102 is an elongated circle rather than round. In other embodiments, the container is round. In a suitable embodiment, the container 102 has a length 140 and a width 142. In one embodiment, the neck 116 is entirely within the front 20% of the length 140 of the container 102 and the handle 112 stretches across greater than 80% of the length 140 of the container 102. The elongated container, the extended handle position, the separate handle opening to the neck, the forward neck, or combinations of these allow for effective directed pouring out of the front of the bottle.

Suitably, the dispensing closure 120 of the invention is provided with an inner female thread typically located in the base member 122, as described hereinafter, and the container neck 116 is provided with an exterior male thread 150 formed adjacent its dispensing opening 108. Typically, the dispensing closure 120 is mounted onto the container 102 with the female thread of the base member 122 screwed on the male thread 150 of the container 102. Alternatively, the container 102 may not need having a neck 116. Instead the container 102 may consist of a just a body portion 104 with a dispensing opening 108. The dispensing closure 120 of the present invention is suitable for use with a variety of conventional or special containers having various designs, the details of which, although not illustrated or described, would be apparent to those skilled in the art. The container 102 may have a rigid wall or walls, or may have a somewhat flexible wall or walls.

In a suitable aspect of the invention shown in FIGS. 1 and 2, the dispensing closure 120 is a separate element which is adapted to be removably or non-removably mounted, via its base member 122, to a previously manufactured container 102 which has a dispensing opening 108 to the container interior. In an alternative execution, the dispensing closure 120 may be formed as a unitary part, or extension, of the container 102. The dispensing closure 120 is adapted to be used with a container 102 having a dispensing opening 108 to provide access to the container interior volume and to a product contained therein, which is preferably a pourable product. However, the dispensing closure 120 of the invention may be used with many products, including but not limited to, relatively low or high viscosity liquids, creams, gels, suspensions, mixtures, lotions, pastes, particulates, granular products, and mixtures thereof. Typical products for use in the present invention may be those constituting a food product, a personal care product, an industrial or household cleaning product, or other compositions of matter for use in activities involving manufacturing, commercial or household maintenance, construction, agriculture. Suitably, said pourable product is a liquid composition.

The container neck 116 may be a simple threaded closure or may have in addition to the male thread 150, several functional elements to prevent removal of the base member 122 of the dispensing closure 120. As shown in FIGS. 3 and 4, the container neck 116 has two or more ratchets 152, 153 and a closure stop 154 on the neck base 156 to interact with the dispensing closure 120 during attachment of the dispensing closure 120. Suitably, one or more of the ratchets 153 is located at the top of the handle neck base 158 and one or more of the ratchets 152 is located on the container front neck base 160. The closure stop 154 is suitably located on the container front neck base 160. An anti-removal stop 155 is located on the handle neck base 158. At the bottom of the neck 116 are the container outlet 162 and the handle venting inlet 164.

Figure 5:
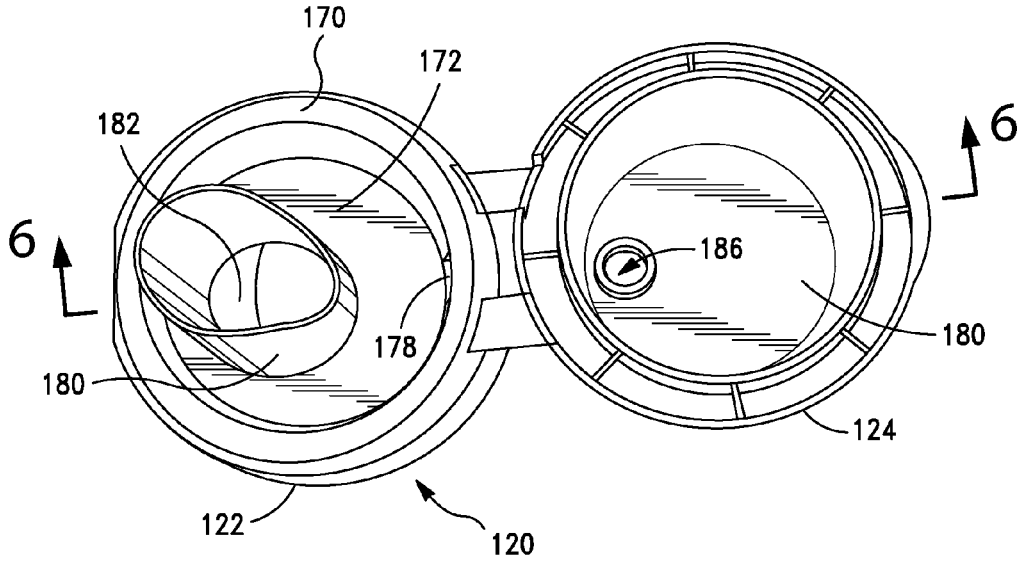
FIG. 5 shows a perspective view of a closure portion according to the present invention.

Showing the dispensing means 120 in an open position in FIG. 5 the base member 122 may have any suitable configuration, form or dimension for accommodating an upwardly projecting neck 116 or portion of a container 102 (FIG. 2). In a suitable execution of the present invention, the base member 122 has a substantially round shape when seen from the top perspective, as represented in FIG. 5. The base member 122 is comprised of two distinct parts, an annular skirt member 170 and a deck member 172. The skirt member 170 generally forms the external and surrounding wall of the base member 122 and extends substantially towards the container direction, typically parallel to the neck 116 of the container 102 (FIG. 3). The deck member 172 which typically extends substantially transversely to the longitudinal axis of the container 102 is generally substantially flat and horizontal or slightly slanted.

Figure 6:
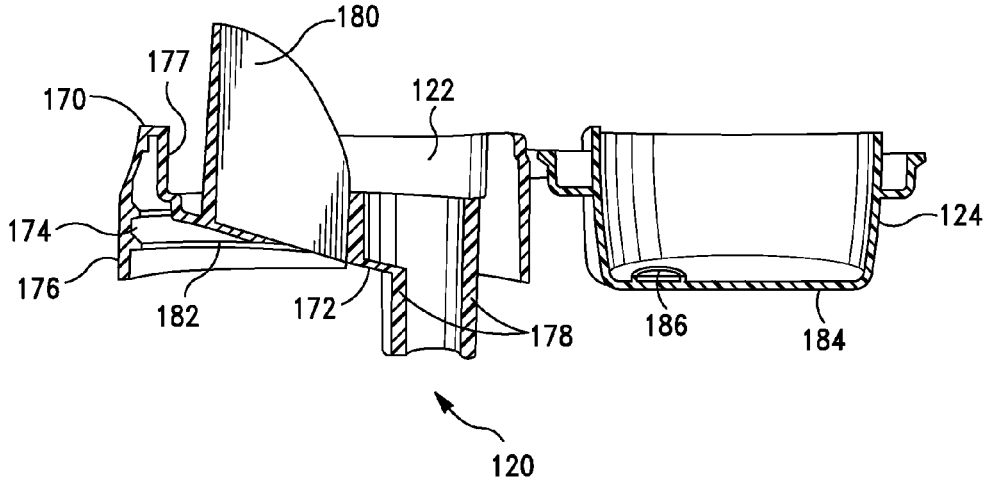
FIG. 6 shows a cross-sectional view of a closure portion according to the present invention.

More specifically, and as shown in FIGS. 5 and 6, the female thread means 174 for attachment of the base member 122 to the neck 116 is suitably located onto the inner portion of the outer wall 176 of the skirt member 170 of the base member 122. The skirt member has an inner wall 177 connecting to the deck member 172. The deck member 172 of the base member 122 comprises a venting channel 178 adapted to communicate with the interior volume of the handle 112 through the handle inlet 164 (FIG. 4). The deck member 172 also comprises a beveled spout member 180 which extends upward from the deck member 172 to dispense product from the container 102 through the container outlet 162 (FIG. 4). Also shown is a spout deflector 182 at the bottom of the spout member 180 which acts to moderate the pouring stream out of the spout member 180. The top 184 of the cap 124 can also have a venting pad 186 for venting during storage. The venting pad 186 can overlay a hole in the top of the cap 124 and provide grooved channels for passage of air between the bottle interior and the bottle exterior.

Figure 7:
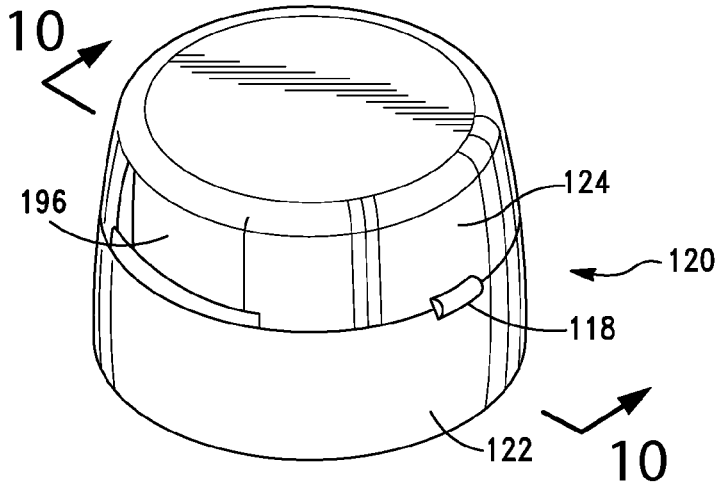
FIG. 7 shows a perspective view of a closure according to the present invention.
Figure 8:
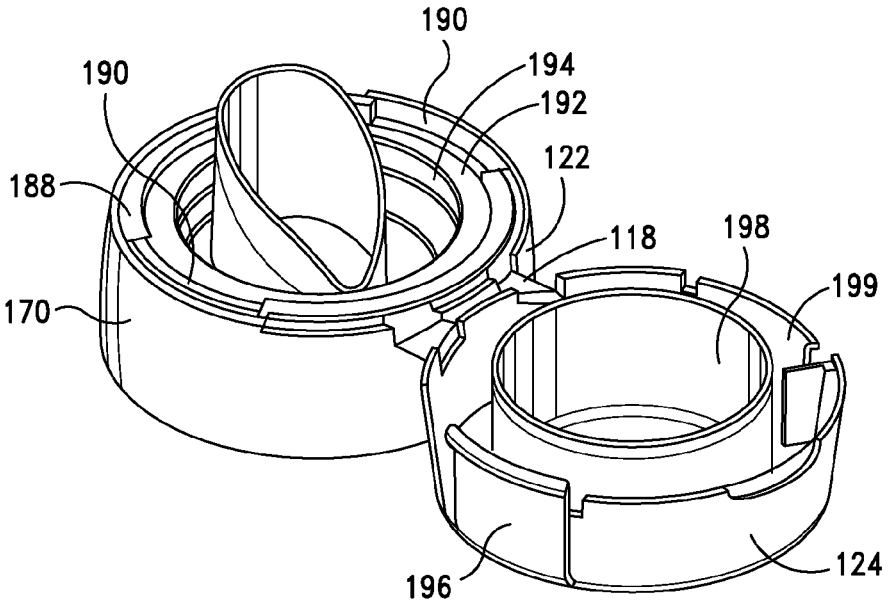
FIG. 8 shows a perspective view of a closure in accordance with an embodiment of the present invention.
Figure 9:
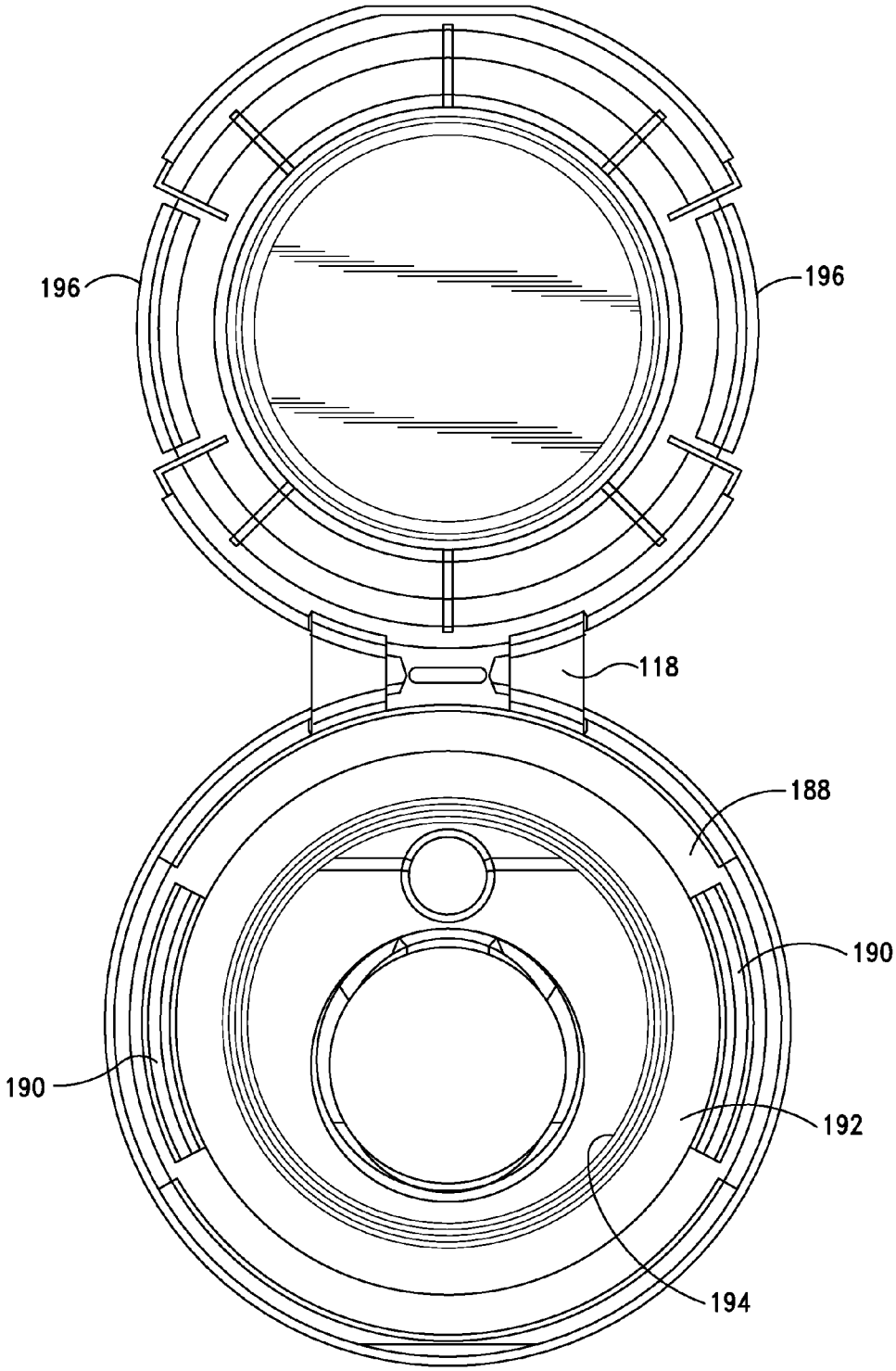
FIG. 9 shows a plan view of a closure in accordance with an embodiment of the present invention.
Figure 10:
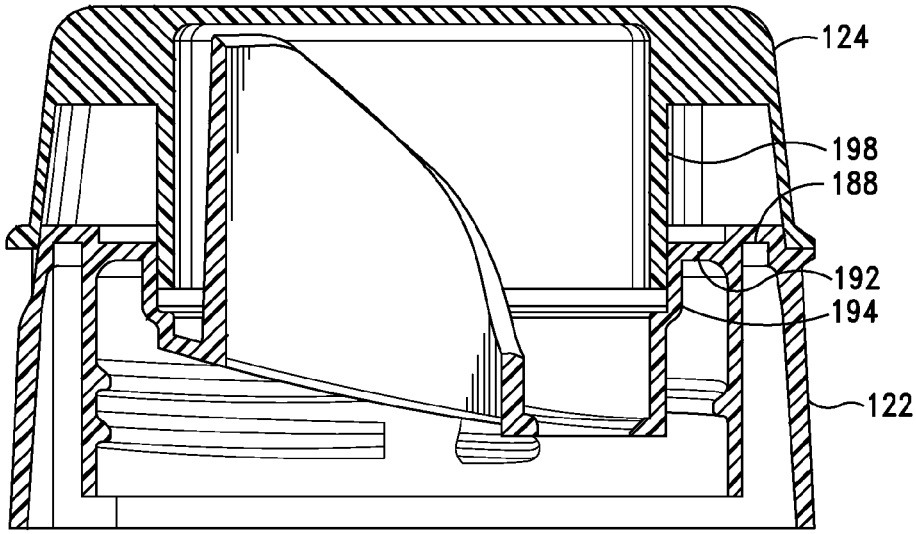
FIG. 10 shows a cross-sectional view of a closure in accordance with an embodiment of the present invention.

Another embodiment of the dispensing closure 120 is shown in FIGS. 7-9. FIG. 7 shows a dispensing closure 120 in the closed position and having a base member 122, a cap member 124 and a hinge 118. FIG. 8 shows the dispensing closure 120 of FIG. 7 in an open position having a base member 122, a cap member 124 and a hinge 118. The skirt member 170 comprises an outer annular skirt 188 having latches 190 and a contiguous indented inner annular skirt 192 having an inner skirt inner surface 194. On each side of the cap member 124 is a tab 196. The tabs 196 can be pushed inward towards each other to release the tabs 196 from the latches 190 in the outer skirt 188 of the skirt member 170 to allow the cap member 124 to swing on the hinge 118 to the open position. As shown in FIGS. 8-10, the cap member 124 also has an inner annular wall 198 concentric with the outer annular wall 199 that frictionally mates with the inner skirt inner surface 194 of the base member 122 to prevent product from leaking from the container 102 (in FIG. 1).

Figure 11:
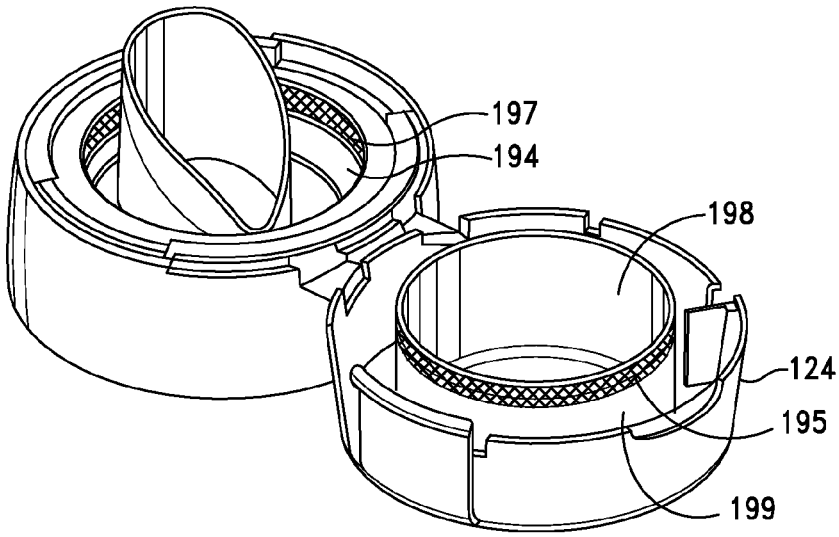
FIG. 11 shows a perspective view of a closure in accordance with an embodiment of the present invention.

When the bottle contains liquid contents that expand or generate gas during storage of the bottle when the nozzle is in the closed position, it may be necessary to include a storage venting means. This passive storage venting means can be achieved by a circuitous channel, such as described in U.S. Pat. No. 6,202,870 to Pearce, or by a porous liner, such as described in U.S. Pat. No. 5,730,306 to Costa et al., both of which are incorporated in the entirety herein. In one embodiment of the invention shown in FIG. 11, the storage venting means can achieved by a pattern of channels 195 on the outer surface 199 of the inner wall 198 of the cap member 124. Alternately, there can be a pattern of channels 197 on the inner skirt inner surface 194. Because these channels 195, 197 are only on vertical surfaces of the dispensing closure 120, there may be less likelihood to foul from product gassing than grooves on horizontal surfaces. In some embodiments, it may be advantageous to have channels 195, 197 on both the outer surface 199 of the inner wall 198 of the cap member 124 and the inner skirt inner surface 194 in order to reduce mold wear. These channels are especially advantageous where two smooth injection molded surfaces fit together. The channels can be laser etched or chemical etched into the molds.

The bottle may have an integrated spout fitment such as described in U.S. Pat. No. 5,794,803 to Sprick, which is incorporated by reference in its entirety herein.

Figure 12:
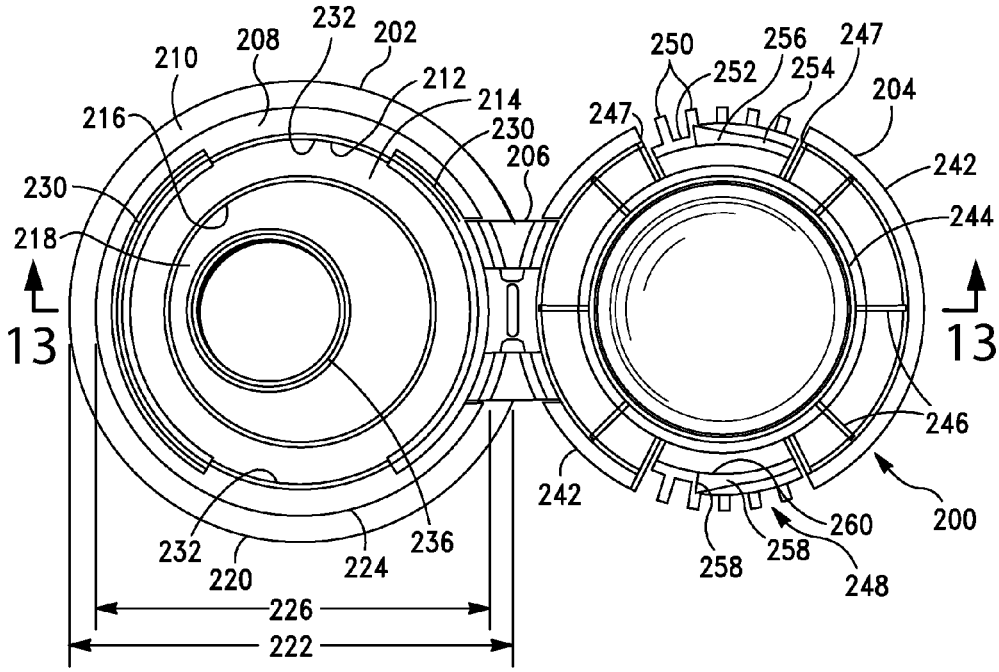
FIG. 12 shows a top view a closure in accordance with an embodiment of the present invention.
Figure 13:
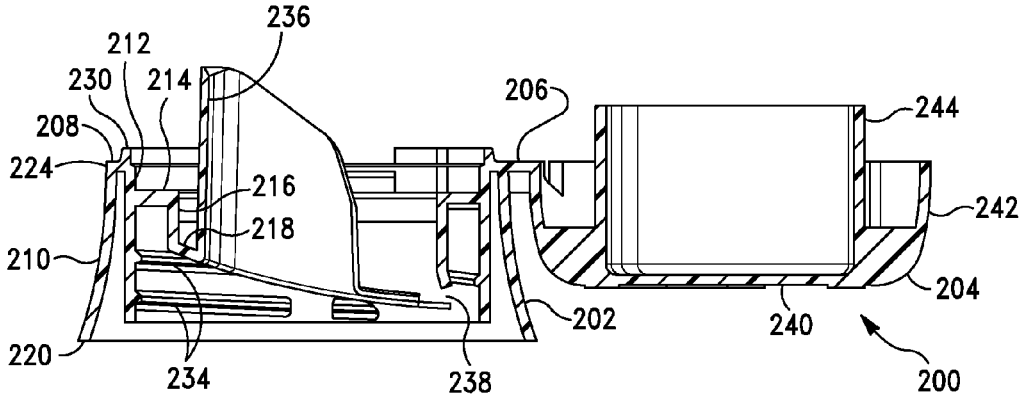
FIG. 13 shows a cross-sectional view of the closure of FIG. 12 along A-A in accordance with an embodiment of the present invention.

The inside of an open flip top closure 200 is shown in FIG. 12 with a cross-sectional view along A-A in FIG. 13, with a base member 202 connected to a cap 204 by a hinge 206. The base member 202 has a top wall 208 including a depending curved flared exterior skirt 210, an intermediate wall 212 connecting to an intermediate deck 214 with a depending inner wall 216 connecting to a lower spout deck 218. The base member curved flared exterior skirt 210 has a bottom surface 220 having a bottom diameter 222 and a top surface 224 having a top diameter 226, where the top diameter 226 can be greater than 5% less than the bottom diameter 222. For example, in one embodiment, the top diameter 226 can be 45 mm and the bottom diameter can be 48.6 mm. The curved flared exterior skirt 210 is a concave curved exterior skirt. The top wall 208 has a pair of guide flanges 230. The intermediate wall 212 has a pair of latches 232 on opposite sides of the interior surface of the intermediate wall 212 orthogonal to the hinge 206. The bottom of the intermediate wall 212 depends from the intermediate deck 214 and has a thread segment 234 on the interior surface of the intermediate wall 212. The term "thread segment" is employed in its usual broad sense to include both single and multiple threads, and both interrupted and continuous threads. The spout deck 218 contains a beveled spout 236. The inner wall 216 contains a drainback hole 238 that can be aligned with the container handle (shown in FIG. 15).

The cap 204 has a cap top 240 and depending exterior cap sidewalls 242. A cap interior wall 244 depends from the cap top 240 and mates with the base inner wall 216 when the flip top closure 200 is closed. The exterior cap sidewall 242 is connected to the cap interior wall 244 by multiple bracing flanges 246. The exterior cap sidewall 242 is discontinuous broken by a pair tab cutouts 247 with tabs 248 on opposite sides and orthogonal to the hinge 206. Each of the tabs 248 is shorter than the corresponding tab cutout 247. Each of the tabs 248 have multiple finger grip flanges 250 attached to the tab wall 252. At the top of each of the tab walls 252 is a lug 254 shorter than the tab wall 252 and having at least one beveled edge 256. The beveled edge 256 is on the side of the lug 254 facing the hinge 206. The beveled edge 256 can have two parallel sides 258 and at least one curved side 260. The beveled edge 256 allows better snap fitment as the cap tab lugs 254 are inserted into the base member latches 232.

Figure 14:
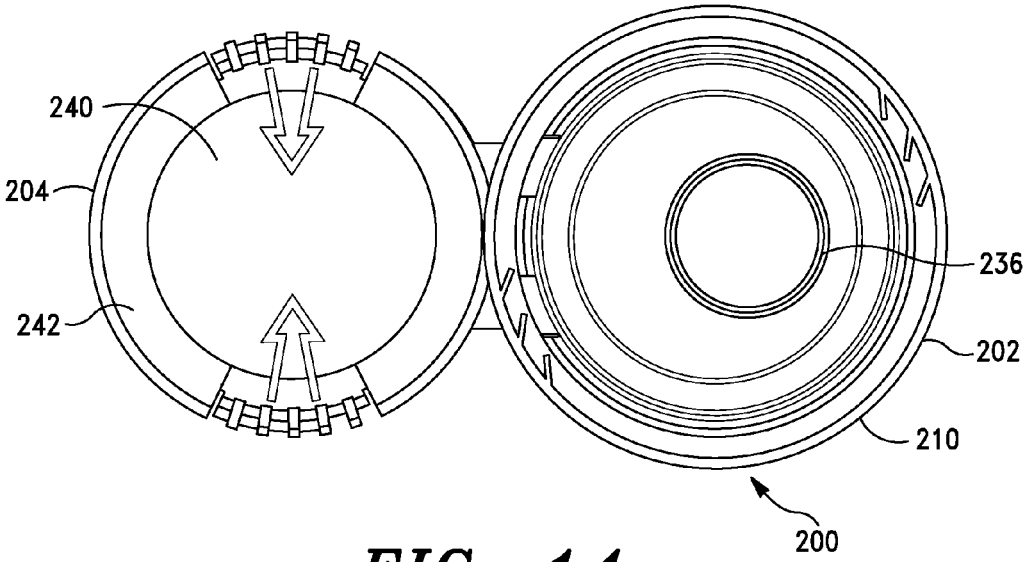
FIG. 14 shows an bottom view of the closure of FIG. 12 in accordance with an embodiment of the present invention.

FIG. 14 shows the open closure 200 with the cap 204 having the cap top 240 with exterior cap sidewalls 242 and the bottom of the base member 202. In one embodiment, the base member 202 has an opaque exterior skirt 210 and the cap 204 has a transparent or translucent cap top 240 and translucent exterior cap sidewalls 242. When the cap top 240 is transparent, it is possible to see the beveled spout 236 when the closure 200 is in the closed position. The transparent cap top 240 also allows translucent instructions to be molded onto the cap top 240. The instructions to squeeze and lift and two arrows are molded onto the cap top 240 and may be translucent for contrast.

Figure 15:
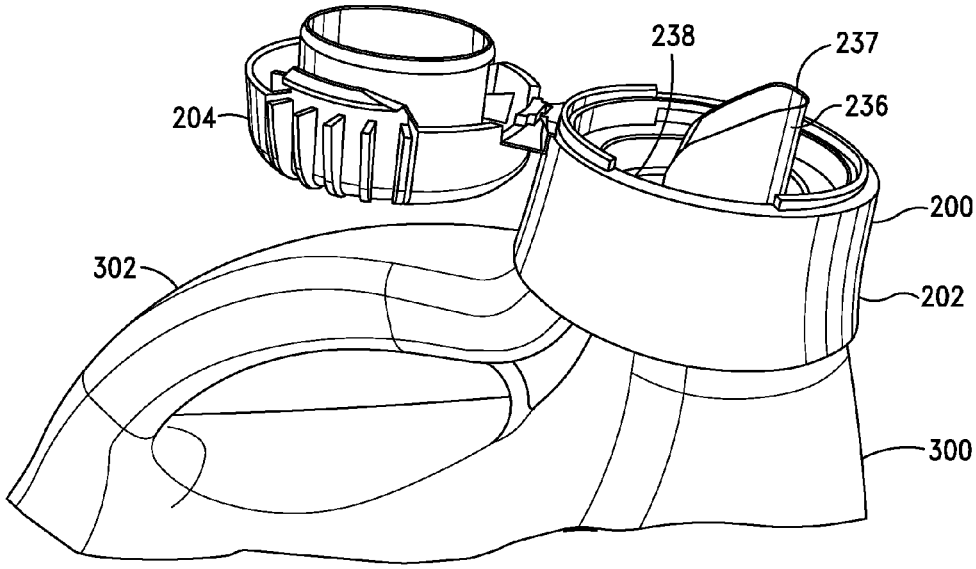
FIG. 15 shows a side perspective view of a closure and container in accordance with an embodiment of the invention.

FIG. 15 shows an open closure 200 with a cap 204 and base member 202 on a bottle 300. The beveled spout 236 has a pouring lip 237 facing the front of the bottle 300 and the drainback hole 238 over the handle 302. The handle 302 may have an inlet as in FIG. 3.

This invention has been described herein in detail to provide those skilled in the art with information relevant to apply the novel principles and to construct and use such specialized components as are required. However, it is to be understood that the invention can be carried out by different equipment, materials and devices, and that various modifications, both as to the equipment and operating procedures, can be accomplished without departing from the scope of the invention itself.

We claim:

1. A bottle comprising:

a container with a top front surface and a top rear surface, the container having a threaded neck on the top front surface and the container having an enclosed handle on the top rear surface, wherein the threaded neck comprises both a dispensing opening and a handle opening that is separate from the dispensing opening; and a dispensing closure configured to engage the container, and comprising:

an opaque base member, comprising:

a top wall;

a curved flared exterior sidewall that depends from the top wall;

an intermediate wall that depends from the top wall and includes a pair of latches and a thread segment;

an intermediate deck connected to the intermediate wall;

an inner wall depending from the intermediate deck; and a lower deck connected to the inner wall, the lower deck including a beveled spout; and a cap having a transparent top and a translucent sidewall, the cap including a pair of tabs, each tab having a tab wall with a corresponding lug configured to lock into one of the latches, and the cap including directions molded to the transparent top, the directions including directions to squeeze and directions to lift; and a hinge connecting the opaque base member and the cap.

2. The bottle of claim 1, wherein the inner wall additionally comprises a venting channel and the venting channel is fluidly connected to the handle inlet.

3. The bottle as recited in claim 1, wherein the directions are in the form of translucent symbols.

4. The bottle as recited in claim 1, wherein the inner wall includes a drainback hole aligned with the enclosed handle.

5. The bottle of claim 1, wherein the curved flared exterior sidewall has a top surface and a bottom surface and wherein a difference between a diameter of the top surface and a diameter of the bottom surface exceeds 5% of the diameter of the bottom surface.

6. The bottle of claim 5, wherein each of the lugs has at least one beveled edge.

7. The bottle of claim 6, wherein each of the lugs is shorter than the corresponding tab wall.

8. The bottle of claim 6, wherein one of the beveled edges has a curved side.

* * * * *